US005745032A

United States Patent [19]

Sturm

[11] Patent Number: 5,745,032

[45] Date of Patent: Apr. 28, 1998

[54] PROCESSING FACILITY ALERT AND ALARM INDICATIONS FOR MULTIPLEXED TRANSMISSION FACILITIES HAVING A PLURALITY OF MULTIPLEX LEVELS

[75] Inventor: Douglas Walter Sturm, Wheaton, Ill.

[73] Assignee: Lucent Technologies Inc., Murray Hill, N.J.

[21] Appl. No.: 703,141

[22] Filed: Aug. 29, 1996

[51] Int. Cl.[6] ..... G08B 29/00

[52] U.S. Cl. ..... 340/506; 340/507; 340/517; 340/521; 340/527; 340/525; 340/309.15

[58] Field of Search ..... 340/506–508, 340/511–513, 517, 518, 521, 527, 529, 525, 309.15; 364/143

[56] References Cited

U.S. PATENT DOCUMENTS

| | | | |
|---|---|---|---|
| 4,117,479 | 9/1978 | Galvin et al. | 340/506 |
| 4,423,410 | 12/1983 | Galvin et al. | 340/506 |
| 4,611,197 | 9/1986 | Sansky | 340/522 |
| 4,749,985 | 6/1988 | Corsberg | 340/517 |

*Primary Examiner*—Donnie L. Crosland

[57] ABSTRACT

In large multi-tiered hierarchical alarm systems for high capacity telecommunications transmission systems, it is important to notify the maintenance craft of only the highest alarm, and to notify only when the alarm has been validated by persisting for a sufficiently long time. Advantageously, this is accomplished by timing alarms and freezing the timing when a higher level alarm is detected. If the higher level alarm is no longer present, timing on the lower level frozen alarm signal continues until there is a timeout. A timed out alarm is reported to the maintenance craft.

10 Claims, 2 Drawing Sheets

PROCESSING FACILITY ALERT AND ALARM INDICATIONS FOR MULTIPLEXED TRANSMISSION FACILITIES HAVING A PLURALITY OF MULTIPLEX LEVELS

TECHNICAL FIELD

This invention is related to the processing of facility alert and alarm indication signals for transmission facilities having several levels of multiplexing in a telecommunication network.

PROBLEM

Transmission facilities are used to interconnect the switching systems of a telecommunications network. These transmission facilities are usually multiplexed so that a single transmission medium, such as a coaxial cable or an optical fiber, can carry a bundle of separate communications. In the more modern transmission facilities, the multiplexing is more complex in the sense that a plurality of primary bundles of communications make up a secondary bundle, for transmission over a single facility. When trouble occurs, it may affect a single primary bundle, or a single secondary bundle. Clearly if a single secondary bundle is affected, then all the primary bundles within that secondary bundle are similarly suspect.

The term Carrier Group Alarm (CGA) is used to indicate that a transmission facility is apparently defective which causes calls to be disconnected and trunks to be made unavailable. A Facility Alert is a signal used to indicate a less severe transmission problem which does not cause calls to be disconnected or trunks made unavailable. When a Carrier Group Alarm is detected, all communications for that carrier group are terminated, and no more communications are to be transmitted over that facility. (The individual members of the primary bundles are called trunks in telephone terminology.) Similarly, when a Facility Alert is detected, maintenance craft are informed so that a test of that facility can be conducted and, if necessary, the facility be taken out of service until repaired.

Clearly, the consequences of a recognized Facility Alert or Carrier Group Alarm are substantial because of the number of communications and trunks affected. Consequently, it is important to insure that a Carrier Group Alarm or Facility Alert is real before taking action. This is especially important if the problem is not a solid fault but intermittent fault or a marginal condition which can appear to be a fault at times. Within a primary or secondary group, there are several levels of alarms. For example, in a 24 channel carrier system such as the Digital Signal Level 1 (DS1) signal, there are several levels of alarms such as Alarm Indication Signal (AIS) (indicating an alarm in a previous transmission system), loss of frame (LOF), and a yellow alarm signal (indicating that the far end is not receiving a signal). The levels form a hierarchy within the hierarch of primary and secondary bundles.

When a secondary facility bundle fails, alarm indications or Facility Alerts for each of the secondary bundles and primary bundles corresponding to the secondary bundle are also detected. If the maintenance craft is not properly alerted, they may spend a large amount of time attempting to fix the wrong condition. It is, therefore, important that they be notified only of the highest level bundle (i.e., secondary as opposed to primary) of an Alarm Indication or Facility Alert, and of the highest level of the alarm within the affected bundle.

Further, there is a hierararchy of alarm types within the alarms of a primary or secondary bundle, and any higher alarm predominates over a lower alarm in the hierarchy.

In one proposed solution to this problem, alarms and alerts are not reported until they have timed out. The time out interval for a secondary alarm or alert is shorter than the timeout interval of a primary alarm, and unless a higher level alarm or alert is subsequently recognized, only the first alarm which times out is reported to the maintenance craft. This arrangement is satisfactory for hard faults but is not adequate for handling intermittent faults or marginal conditions, because under those circumstances, the delay between an initial Facility Alert, or group alarm for a primary group, may be detected substantially before the corresponding alarm or Facility Alert signal for the secondary group. The processing of the alarm indication and Facility Alert indications under these circumstances tends to overload the processing capabilities of the alarm processing systems and tends to generate too many false indications to the maintenance craft. Further, this arrangement violates the standards for alarm reporting of SONET troubles, and is therefore restricted to non-SONET applications.

Accordingly, a problem of the prior art is that there is not a fully satisfactory arrangement for processing alarm indications in multi level carrier transmission facilities, especially for SONET applications.

SOLUTION

The above problem is solved and an advance is made over the prior art in accordance with this invention wherein: each alarm or Facility Alert signal is first timed before any indications are reported and acted upon; if during the course of this timing, a higher level alarm or (in the case of the Facility Alert signal) Facility Alert indication is detected, the timing is frozen; frozen timing can be resumed from the point at which the timing was frozen; if the higher level alarm indication or Facility Alert signal persists until a timeout, then that signal is reported and the lower level indication suppressed; if the higher level signal disappears, timing is resumed on the lower level signal, and if a timeout then occurs the lower level alarm or Facility Alert indication is reported. Advantageously, this arrangement insures that only the pertinent highest level alarm indication or Facility Alert signal is recognized and acted upon. Timing continues only as long as the Facility Alert or alarm signal persists; when a timed signal disappears for a sufficient interval, timing is cleared and the initial indication is effectively ignored or simply recorded for subsequent statistical analysis.

In accordance with one aspect of applicant's invention, alarm signals are monitored over a period of time to determine if the alarm signal requires attention. A timing counter is incremented for each period that the alarm signal is present, and decremented when the alarm signal is gone. The increment and decrement amounts need not be the same; for example, for a far end alarm, the decrement amount is much larger than the increment amount so that a far end alarm indication can be cleared quickly if the far end condition has been fixed.

DETAILED DESCRIPTION

Figure 1:
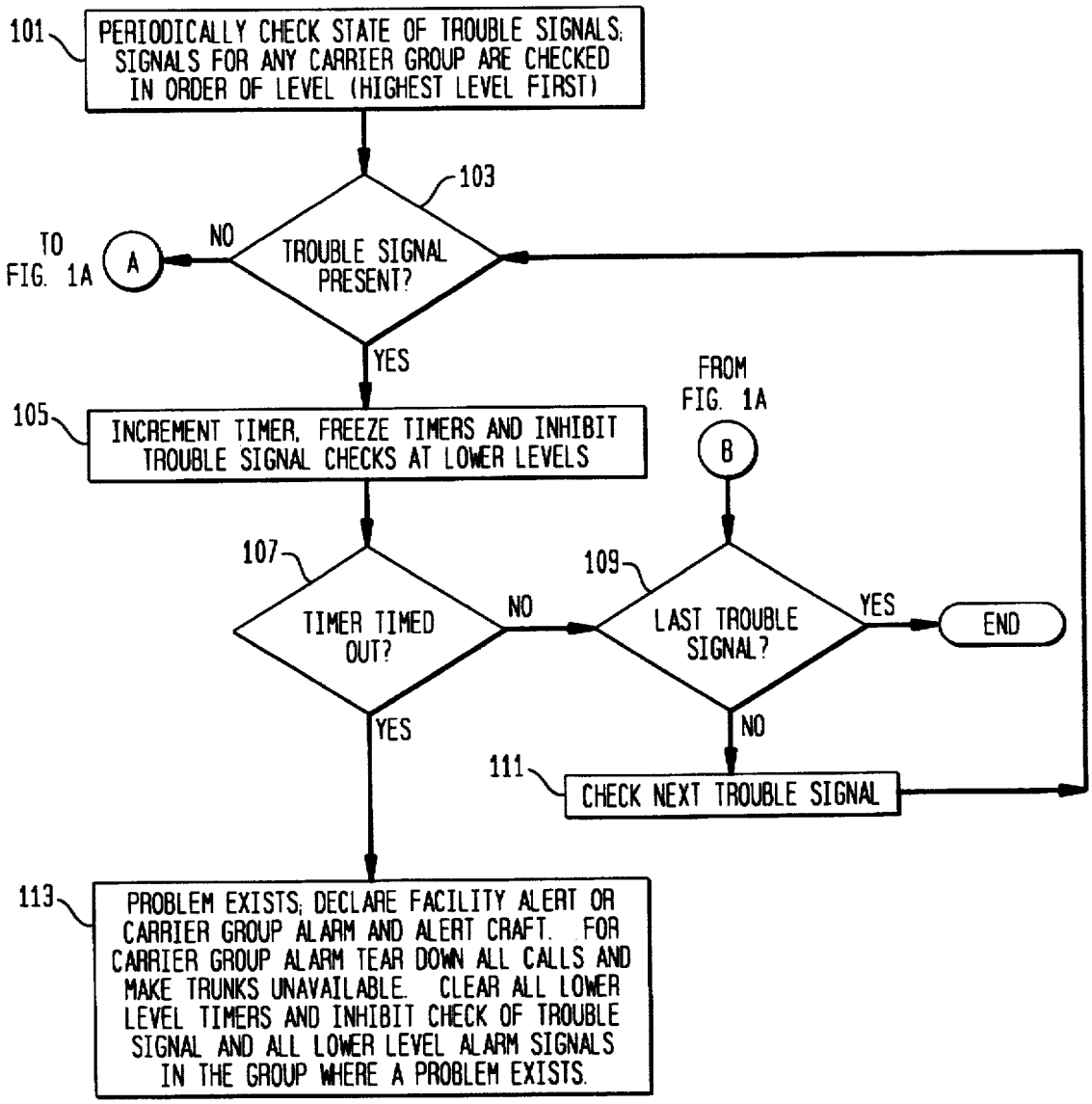
FIGS. 1 and 1A are flow diagrams illustrating the method of applicant's invention.
Figure 1A:
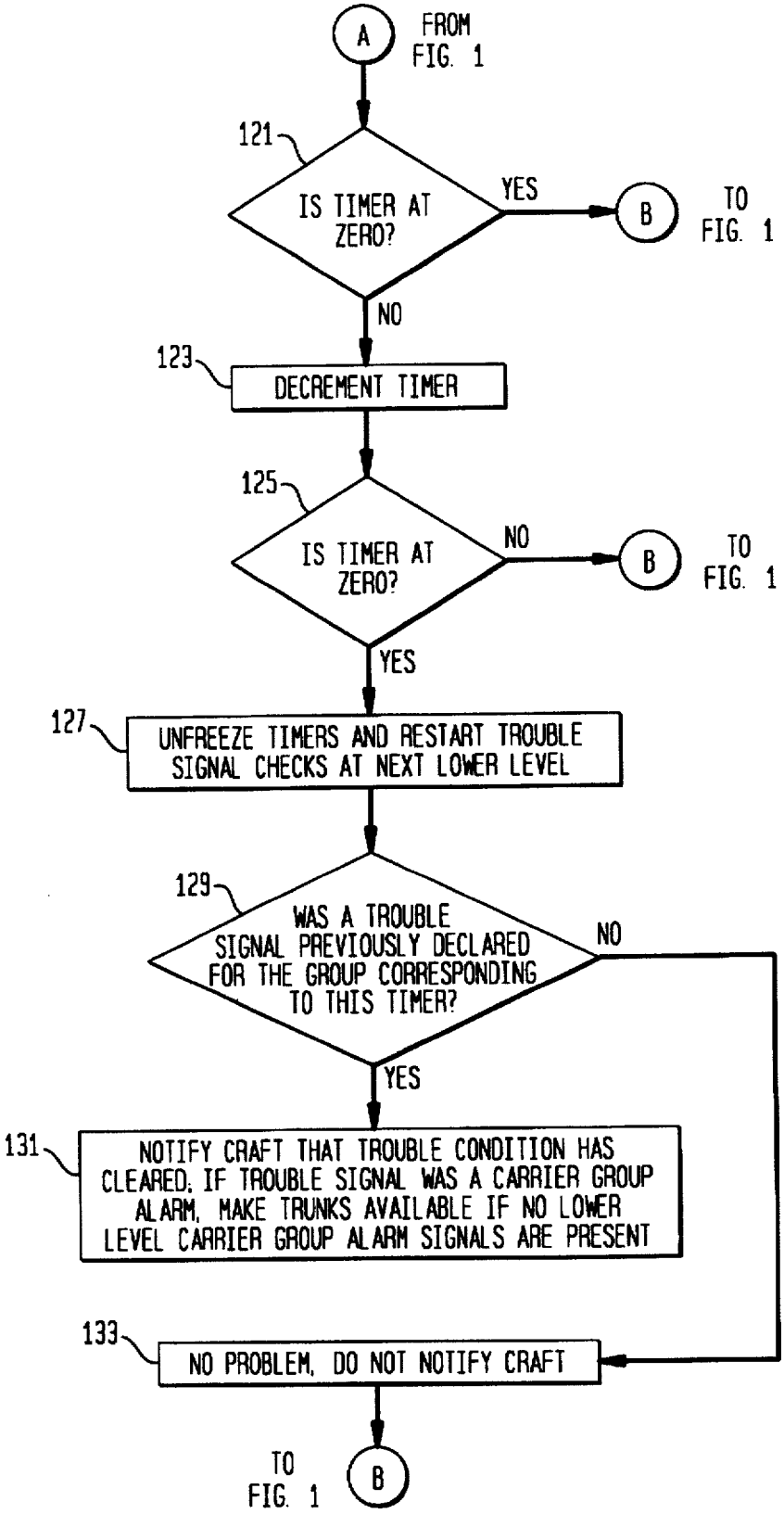

FIG. 1 illustrates the processing of Facility Alert signals and Carrier Group Alarm signals. A higher level signal is one which is for a larger group that includes as a sub-group the entity for which the Facility Alert or Carrier Group Alarm signal is being processed, or for a more serious type of condition for the same groups. The signal itself is one which represents that a condition has been detected. The persistence of such a signal for an interval corresponding to the timeout interval, is an indication of a high probability of a trouble condition requiring the attention of maintenance craft. Since the signal for a lower level group is likely to be active when the trouble is in the higher level group, steps are taken to report only the highest level legitimate trouble indication.

There are two types of trouble signals, a Carrier Group Alarm and a Facility Alert. A Carrier Group Alarm is the more serious signal. If it persists long enough for the timer to time out, then the trunks of that carrier should not be used until the trouble condition is cleared. In the case of a Facility Alert, the maintenance craft is notified of a condition possibly representing a marginal or intermittent fault, which should be attended to. Because of the seriousness of a carrier group alarm condition the presence of a facility alert does not inhibit the check and the timing of carrier group alarm signals at lower levels.

In applicant's preferred embodiment, there are twelve levels of alarms, three each associated with a DS1 signal; a Virtual Tributary (VT) which includes the DS1 signal plus overhead data; a Synchronous Transport Signal (STS) which includes 28 DS1 signals; and a Sonet Terminating Equipment (STE) which includes the STS signal plus Sonet overhead data. The DS1, VT, STS and STE each have three levels of alarms.

The system periodically checks for trouble signals (Action Block 101). The hierarchy is in two parts: the more significant part is the level of the signal; the less significant part is the nature of alarm. The check is made in an order of level with the highest level checks being made first for any particular entity so that, for example, the check for a STE alarm is made before checks of the subtended STS, VT and DS1 alarms. Test 103 is used to determine if a trouble signal is present for one of the signals being checked in Action Block 101. If a trouble signal is present, then the timer associated with that trouble signal is incremented and timers for lower level subtended signals are frozen in their present state by inhibiting trouble signal checks for these signals (Action Block 105). (A frozen timer maintains its present state until unfrozen.) The inhibition of a trouble signal check prevents its timer from being either incremented or decremented.

The increment may be of a different value than the decrement. In general, the increment for near end trouble signals is high compared to the decrement, whereas for far end trouble signals the increment is low compared to the decrement. This enable the system to respond quickly to the clearing of far end trouble indications, and to respond more deliberately to the clearing of near end trouble indications.

Test 107 is then used to determine if the timer has timed out as a result of the incrementing action of Action Block 105. If not, then test 109 determines whether this is the last trouble signal being periodically checked. If not, then the next trouble signal is checked (Action Block 111) and test 103 is reentered. If this is the last trouble signal, this is the end of the periodic check of trouble signals until the next period.

If the timer does time-out, this is an indication that a problem exists. A Facility Alert or a Carrier Group Alarm is declared to exist and the craft is alerted (Action Block 113). If this is a Carrier Group Alarm, all calls on that carrier group are torn down and the trunks for the carrier group are made unavailable. To prevent further confusion, the timers for all lower levels of the carrier group are cleared at this time. Following Action Block 113, test 109 is entered in order to check for other trouble signals.

If the result of test 103 is that there is no trouble signal present on the particular signal being queried, then test 121 is used to determine whether the timer for this trouble signal is at zero. If it is, then test 109 is entered in order to check other trouble signals. If the timer is not zero, then the timer is decremented (Action Block 123). The timer is tested for zero (test 125). If the timer is not at zero, test 109 is entered to continue the scan of trouble signals. If the timer is now at zero then trouble signal checks of the next lower level are restarted and the timers for this level are unfrozen (action block 127). (The process is iterative: if the timer for the next lower level then goes to zero, the timer for the level below is unfrozen.) Next, test 129 is used to determine whether a trouble condition had been previously declared to the craft. If the previously declared trouble condition was a Carrier Group Alarm, then the trunks are made available only if no Carrier Group Alarm signals are present at any lower lever (action block 131). Test 109 is reentered in order to continue the periodic check of all trouble signals. If the result of test 129 is negative, i.e., if no trouble condition had been previously declared, then this represents a situation in which there is no apparent problem since the trouble signal cleared within the time and interval, and there is no need to notify the craft (action block 133). The periodic check for trouble signals is continued and test 109 is reentered.

Many variations can be derived by those of ordinary skill in the art without departing from the scope of the invention. The invention is only limited by the attached claims.

I claim:

1. In a multi-level hierarchical alarm system, a method of reporting a specific alarm signal out of a plurality of alarm signals, comprising the steps of:

for each specific alarm signal, performing timing using a timer corresponding to said each specific alarm signal;

if said specific alarm signal becomes active, freezing timing for all lower level alarm signals included in and below said specific alarm signal in a hierarchy of alarm signals;

if said specific alarm signal is absent, unfreezing timing for a lower level alarm indication included in said specific alarm signal; and reporting said specific alarm signal if the timer corresponding to said specific alarm signal times out.

2. The method of claim 1 wherein said timing comprises the steps of:

incrementing a timer periodically if an alarm signal corresponding to said timer is present; and decrementing said timer periodically if said alarm signal corresponding to said timer is absent.

3. The method of claim 2 wherein an amount of an increment is different from an amount of a decrement.

4. The method of claim 3 wherein said amount of an increment and said amount of a decrement are different for different ones of said plurality of alarm signals.

5. The method of claim 4 wherein an amount of an increment is less than an amount of a decrement for alarm signal indicative of far end trouble conditions.

6. The method of claim 2 wherein the step of performing timing comprises the step of checking an alarm indicator periodically.

7. The method of claim 6 wherein the step of freezing timing comprises the step of inhibiting a periodic check of an alarm signal corresponding to the frozen timing.

8. The method of claim 6 wherein the step of unfreezing timing comprises the step of resuming a periodic check of an alarm signal corresponding to the unfrozen timing.

9. The method of claim 2 wherein the step of unfreezing timing comprises the step of:

if the step of decrementing causes a timer to return to an initial state, unfreezing timing for a lower level alarm signal timer.

10. The method of claim 9 wherein said unfreezing timing for a lower level alarm signal timer comprises unfreezing timing only for timers that are one level lower.

* * * * *